US005249669A

United States Patent [19]

Resnick et al.

[11] Patent Number: 5,249,669

[45] Date of Patent: Oct. 5, 1993

[54] DISPLAY CONTAINER

[76] Inventors: Michael Resnick, 9830 Huber La., Niles, Ill. 60648; Harold E. Cravens, 6521 Winston Dr., Woodridge, Ill. 60517

[21] Appl. No.: 996,625

[22] Filed: Dec. 24, 1992

[51] Int. Cl.[5] ..... B65D 5/38

[52] U.S. Cl. ..... 206/45.15; 206/232; 206/425; 229/10; 229/120.32; 229/120.37

[58] Field of Search ..... 206/44.12, 45, 45.11, 206/45.15, 232, 425; 220/503, 525, 528; 229/9, 10, 11, 19, 20, 120.01, 120.03, 120.29, 120.32, 120.37, 120.38, 121; 312/261, 334.46, 334.44

[56] References Cited

U.S. PATENT DOCUMENTS 2,350,280 5/1944 Holtzman ..... 312/261
2,706,066 4/1955 Wells ..... 229/121
3,050,228 8/1962 Lane ..... 229/120.32
4,138,052 2/1979 Torigian ..... 229/120.32
4,437,713 3/1984 Roach ..... 312/261
4,805,765 2/1989 Barrett et al. ..... 229/11

*Primary Examiner*—Jimmy G. Foster
*Attorney, Agent, or Firm*—Richard W. Carpenter

[57] ABSTRACT

A display container for holding, displaying, and dispensing articles such as literature and samples. The container is formed from several paperboard components and has a tubular body with upper and lower insert pieces positioned within the body to divide the interior of the body into separate compartments, one of which is adapted to hold a drawer that can be pulled out from the body.

19 Claims, 5 Drawing Sheets

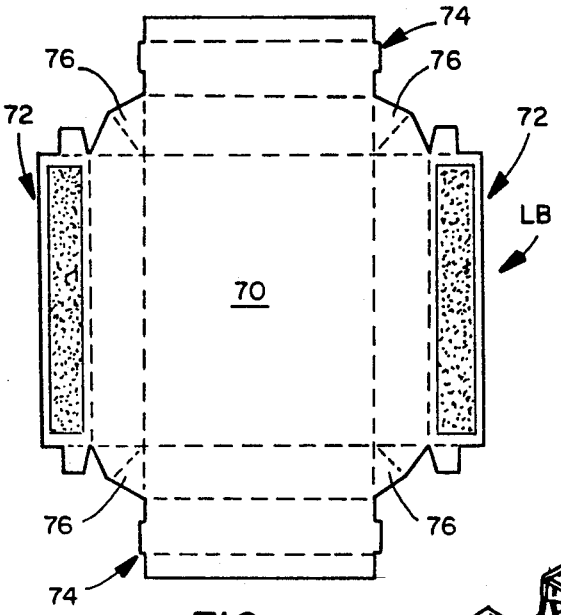
FIG.9
FIG.8
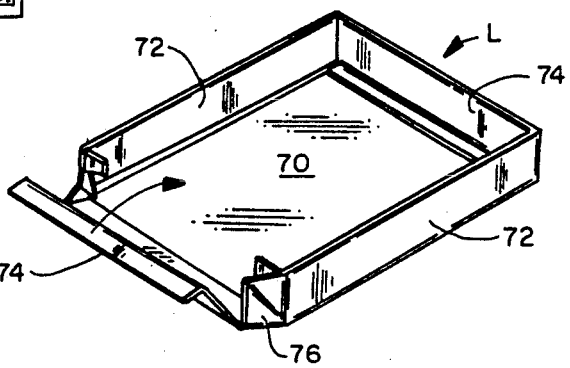
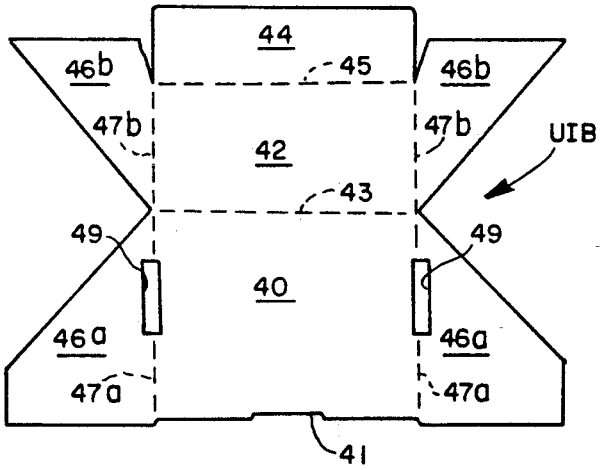
FIG. 10
FIG. 11
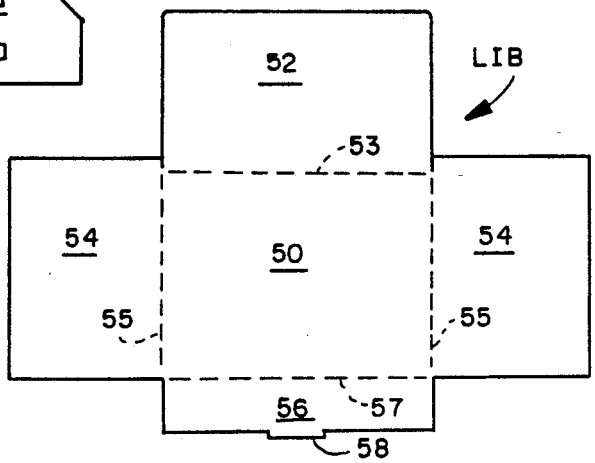

DISPLAY CONTAINER

BACKGROUND OF THE INVENTION

1. Field of the Invention

This invention relates to display containers and more particularly to a paperboard container with a plurality of separate compartments, including one with a sliding drawer, for holding and displaying articles, such as informational material including product literature and samples.

2. Description of Background Art

A background art search directed to the subject matter of this invention and conducted in the United States Patent and Trademark Office disclosed the following U.S. Pat. Nos.: 1,179,973, 1,570,336, 2,021,003, 2,269,676, 2,584,048, 3,308,934, 3,908,821, 4,809,847.

None of the patents uncovered in the search discloses a display container including a hollow, tubular housing member having a pair of insert members that cooperate with each other to provide a horizontal shelf extending between the side walls of the housing member and forming separate upper and lower compartments, one of which contains a sliding drawer.

SUMMARY OF THE INVENTION

It is a primary object of this invention to provide an improved paperboard container for holding and displaying articles such as informational literature and samples.

Another object is the provision of a display container that is attractive and also different in appearance and operation from conventional types of display containers.

A more specific object of the invention is to provide a display container having more than one compartment and a drawer.

These and other objects of the invention will be apparent from an examination of the following description and drawings.

BRIEF DESCRIPTION OF THE DRAWINGS

FIG. 8 is a fragmentary plan view of the container lid illustrated in FIG. 1, shown inverted and in a partly erected condition;

FIG. 9 is a plan view of the blank of foldable sheet material from which the lid may be formed;

FIGS. 10 and 11 are plan views of the blanks of foldable sheet material from which the upper and lower insert members, respectively, may be formed;

Figure 1:
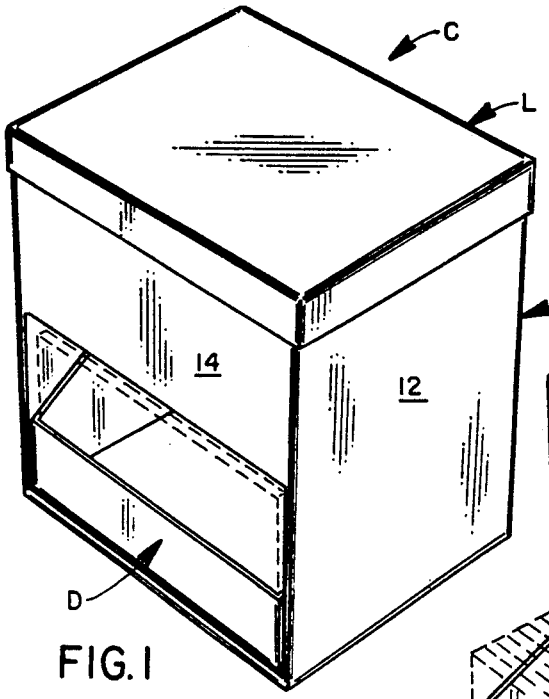
FIG. 1 is a fragmentary isometric view of a display container embodying features of the present invention, shown erected and closed.

It will be understood that, for purpose of clarity, certain elements may have been intentionally omitted from certain views, where they are believed to be illustrated to better advantage in other views.

DESCRIPTION OF THE PREFERRED EMBODIMENT

Referring now to the drawings for a better understanding of the invention, it will be seen that a display container, indicated generally at A and embodying features of the present invention, is illustrated in FIGS. 1–6. The container is adapted to hold, in several compartments, a plurality of articles such as literature and or samples indicated at A in FIG. 2.

The container C includes a generally tubular housing or body B within which are inserted an upper insert member UI and a lower insert member LI, which cooperate to divide the body B into a plurality of compartments. The lower compartment is adapted to receive a pull-out drawer D. If desired, a tray T may be set into in the drawer. The tray is not essential to the invention.

Figure 5:
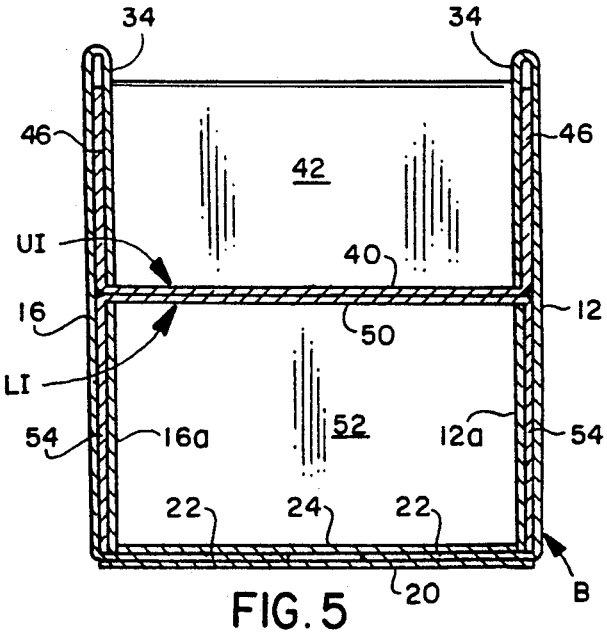
FIGS. 5 and 6 are vertical cross-sectional views taken on lines 5—5 and 6—6, respectively, of FIG. 4.
Figure 6:
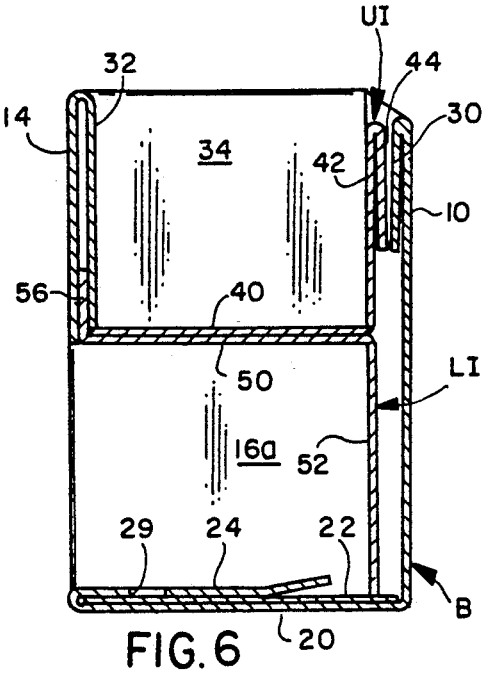
Figure 7:
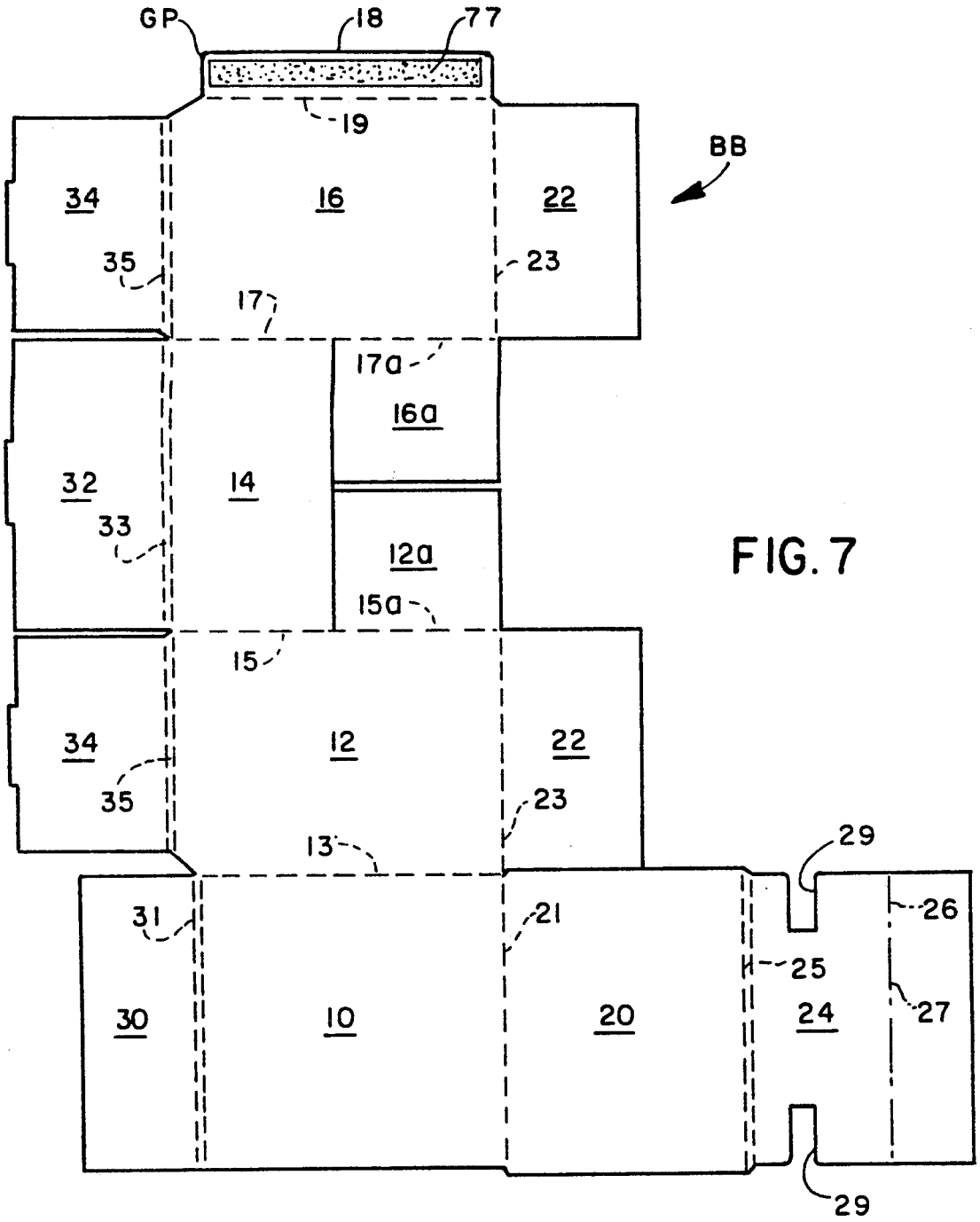
FIG. 7 is a plan view of the blank of sheet material from which the container body illustrated in the other views may be formed.

Referring now to FIGS. 1–6 and 7, it will be seen that the container body B may be formed from a unitary blank BB of foldable sheet material, such as paperboard, illustrated in FIG. 7. Looking at FIG. 7 from bottom to top of the Figure, it will be seen that the central portion of the container body B includes a rear wall outer panel 10, a first side wall outer panel 12, a front wall outer panel 14, a second side wall outer panel 16, and a glue panel 18, which panels are foldably joined to each other along parallel score lines 13, 15, 17, and 19, respectively.

Still referring to FIG. 7, it will be seen that, the lower end of the body B includes a bottom wall that includes a bottom wall outer panel 20, foldably joined to the lower edge of rear wall outer panel 10 along a fold line 21, a pair of bottom wall intermediate panels 22, foldably joined along fold lines 23 to the lower edges of first and second side wall outer panels 12 and 16, and a bottom wall inner panel 24 foldably joined along a preferably double scored fold line 25 to the forward edge of bottom wall outer panel 20.

A pair of side wall lower inner panels **12*a* and 16*a* are foldably joined to front edges of first and second side wall outer panels 12 and 16 along fold lines 15*a* and 17*a***, respectively.

The upper end of the container body includes a rear wall upper inner panel 30, a front wall upper inner panel 32, and first and second side wall upper inner panels 34, which are foldably joined to related body outer wall panels, along preferably double score lines 31, 35, 33, and 35, respectively.

In order to divide the container into separate compartments, there are provided upper and lower insert members UI and LI, respectively, which, as hereinafter described, have related horizontal panels that cooperate with each other to provide a horizontal shelf that divides the container body into upper and lower compartments.

Upper insert member UI, illustrated in FIGS. 2, 3, 5, and 6, may be formed from the blank UIB illustrated in FIG. 10. The upper insert member includes a horizontal bottom panel 40, having a rear inner panel 42 foldably joined to the rear edge thereof along a fold line 43.

Foldably joined to the upper edge of rear inner panel 42, along a fold line 45, is a rear outer panel 44.

Also, upper insert member IU includes a pair of generally triangular side panel first and second sections 46*a* and 46*b*, which are foldably joined, along fold lines 47*a* and 47*b* to opposed side edges of bottom panel 40 and rear inner panel 42, respectively.

When the rear inner panel 42 is folded upwardly at right angles to the bottom panel 40, the side panel sections of each pair become co-planer to form a single side panel.

Along the fold lines 47*a* and 47*b* are a pair of openings 49 which accomodate a Walker-lock connection with related panels of the body member in a manner hereinafter described.

Figure 3:
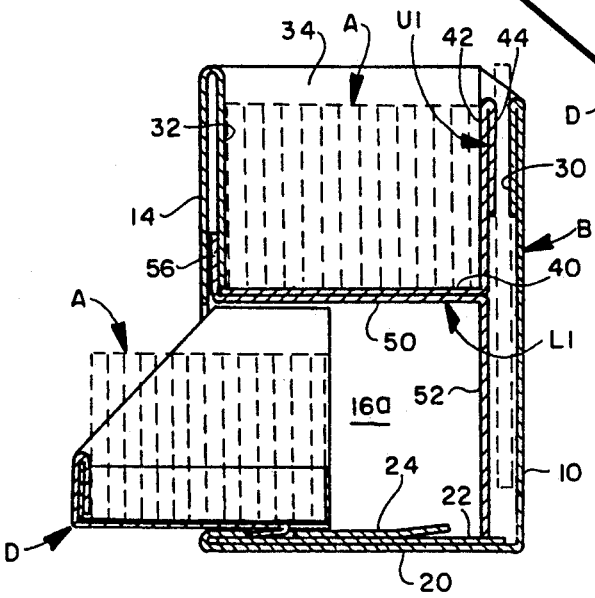
FIG. 3 is a vertical cross-sectional view taken on line 3—3 of FIG. 2.
Figure 4:
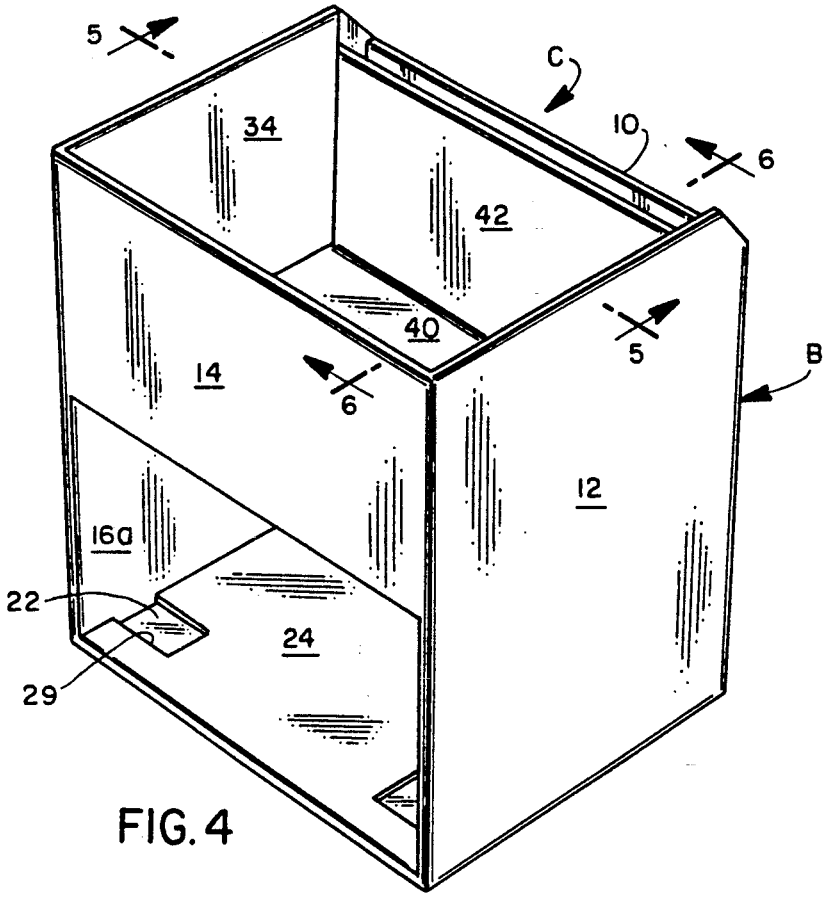
FIG. 4 is another view similar to that of FIG. 1, but with the container lid, lower insert member, and drawer removed.

The lower insert member LI illustrated in FIGS. 3, 5, and 6 may be formed from the unitary blank LIB of foldable paperboard illustrated in FIG. 11.

The lower insert member includes a horizontal top panel 50 having a rear panel 52 and a pair of side panels 54 foldably joined to the rear and side edges thereof along fold lines 53 and 55, respectively, and a front or retaining panel 56 foldably joint to a front edge thereof along a fold line 57. Panel 56 may include a tab 58 projecting from an upper edge thereof.

When the lower insert member is positioned within the lower portion of the body, the rear panel 52 and the side panels 54 extend downwardly from horizontal top panel 50 and are positioned against the inside surfaces of the body rear and side walls, respectively. Retaining panel 56 extends upwardly from horizontal panel 50 and is positioned against the inner surface of the body member front wall outer panel 14.

As the upper insert member is positioned atop the lower insert member within the body, the side panels of the upper insert member are interposed between the body member side wall upper inner and outer panels, with the insert member rear outer panel folded back 180 degrees to lie between the upper insert member rear inner panel and the the body member rear wall inner panel.

When both insert members are positioned in the body, upper insert member bottom panel 40 and lower insert member top panel 50 lie in face-to-face relation to provide a common horizontal wall or shelf that extends between the vertical walls of the body and divides the body into upper and lower compartments.

As best seen in FIGS. 1–3 and 12–14, there is provided a drawer, indicated generally at D, which is adapted for sliding movement into and out of the lower compartment of the body member within the lower insert member LI.

Drawer D includes a generally rectangular bottom wall outer panel 60, having a front wall outer panel 62 foldably joined to a front edge thereof along a fold line 63. Panel 62 has a front wall inner panel 64 joined to an upper edge thereof, along a fold line 65, and also has a pair of side panels 66 foldably joined to opposed side edges thereof along parallel fold lines 67. Panels 66 are generally trapazoidal in shape and have, foldably joined to their respective rear edges, along fold lines 69, a pair of bottom wall inner panels 68.

Figure 12:
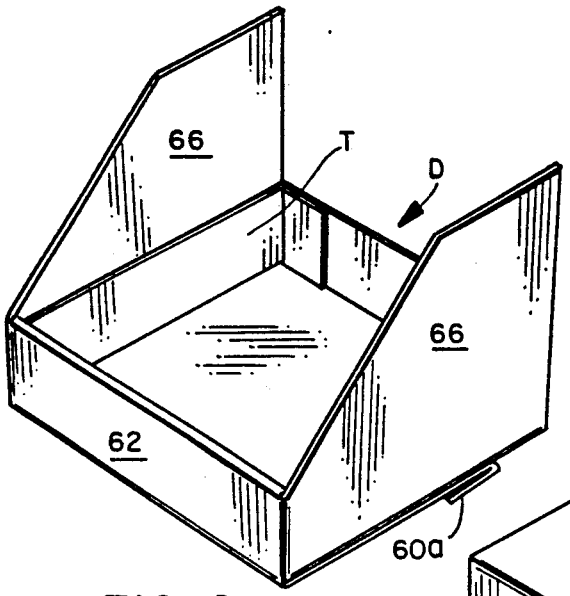
FIGS. 12 and 13 are fragmentary isometric views of the container drawer, shown in upright and inverted positions, respectively.
Figure 13:
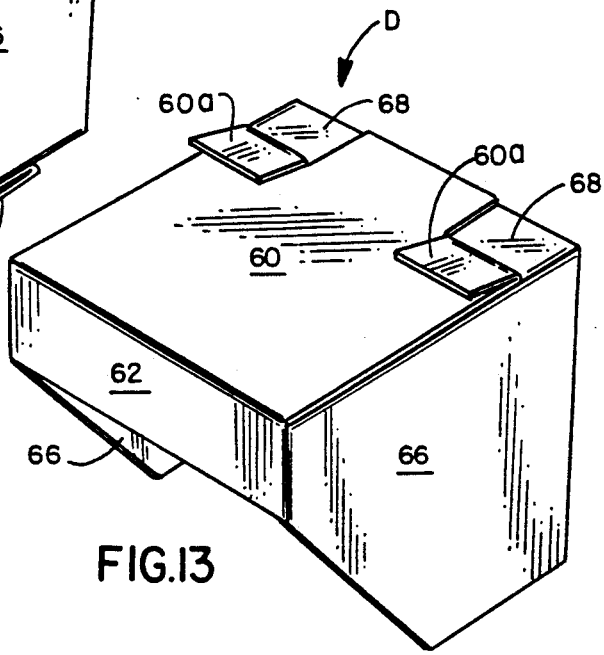
Figure 14:
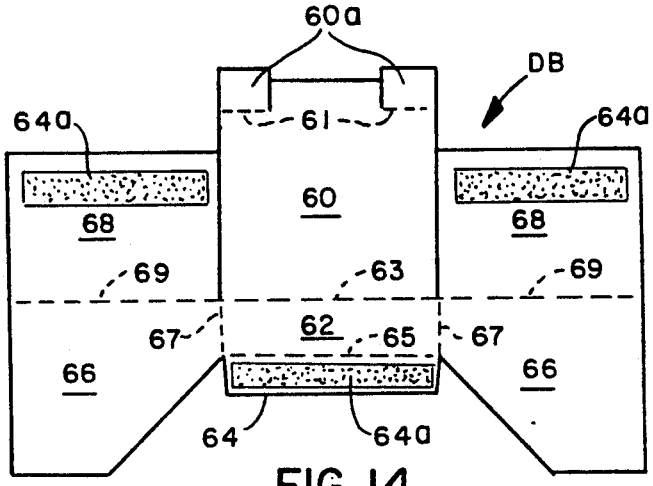
FIG. 14 is a plan view of the blank of foldable sheet material from which the drawer may be formed.

When the drawer is erected to the condition shown in FIG. 12, the front wall outer panel 62 is folded upwardly 90 degrees from the bottom wall outer panel 60, the side panels 66 are folded rearwardly 90 from the front wall outer panel, and the bottom wall inner panels 68 are folded inwardly to overlie and be secured to the upper surface of bottom wall outer panel 60. Front wall inner panel is folded inwardly 180 degrees and is secured to the front wall outer panel. Adhesive areas for the front wall inner panel and the bottom wall inner panels are shown 64*a*.

The remaining portion of the container is the lid, indicated generally at L and illustrated in FIGS. 1 and 8. Lid L may be formed of unitary blank LB of foldable sheet material, such as paperboard as illustrated in FIG. 9. The lid may be of a conventional construction, and includes a top wall 10 having a pair of side walls 72 and end walls 74 foldably joined to and depending from side and end edges thereof along fold lines 73 and 75, respectively.

The side and end walls may be interconnected at the corners of the container by web type corner gussets 76.

In order to assemble the container, the body is first erected by folding the body outer wall panels along the parallel fold lines to and adhesively securing the glue panel 18 to the adjacent surface of rear wall outer panel 10 to form a tubular structure open at the ends.

To close the bottom of the structure, the bottom wall outer panel 20 is folded forwardly from the rear wall outer panel 10, and the bottom wall intermediate panels 22 are folded inwardly to overlie the bottom wall outer panel. The bottom wall outer panel 24 is then folded inwardly 180 degrees to overlie the bottom wall intermediate panels 22. Outer panel 24 may be provided with a fold line 27 to facilitate its insertion into the body member.

After the bottom of the body has been closed as previously described, the body rear wall upper inner panel 30 is folded inwardly 180 degrees to lie against the inner surface of the body rear wall outer panel.

At this point the lower insert member LI may be erected by folding the rear and side panels 52 and 54, respectively, 90 degrees downwardly from the top panel 50 and folding the retaining panel 56 upwardly 90 degrees from the top panel 50.

The lower insert member can then be inserted into the container body from the upper end thereof and pushed all the wall down to the bottom wall of the container, with the rear and side panels of the lower insert positioned against the inner surfaces of the body rear and side wall panels, respectively, and with the retaining panel 56 disposed to lie against the inner surface of the body front wall outer panel.

After the lower insert member has been positioned within the body, the body side wall inner panels 12*a* and 16*a* may be folded inwardly to sandwich the lower insert member side panels between the container side wall inner and outer panels.

The lower edges of the side wall inner panels are held in position by engagment against the side edges of the bottom wall inner panel.

The upper insert member UI may be formed by folding the rear panel inner 42 upwardly 90 degrees from the bottom panel, folding outer wall panel 44 downwardly 180 degrees to lie against the rear surface of the rear wall inner panel 42, and folding the side panel sections 46*a* and 46*b* upwardly and forwardly from the bottom and rear panels 40 and 42, respectively.

The upper insert member can then be inserted into the top of the body with its bottom panel 50 positioned atop the lower insert member top panel in face-to-face relation therewith, so the two horizontal panels cooperate to form a common horizontal wall that extends between the vertical walls of the body and divides the body into upper and lower compartments.

Figure 2:
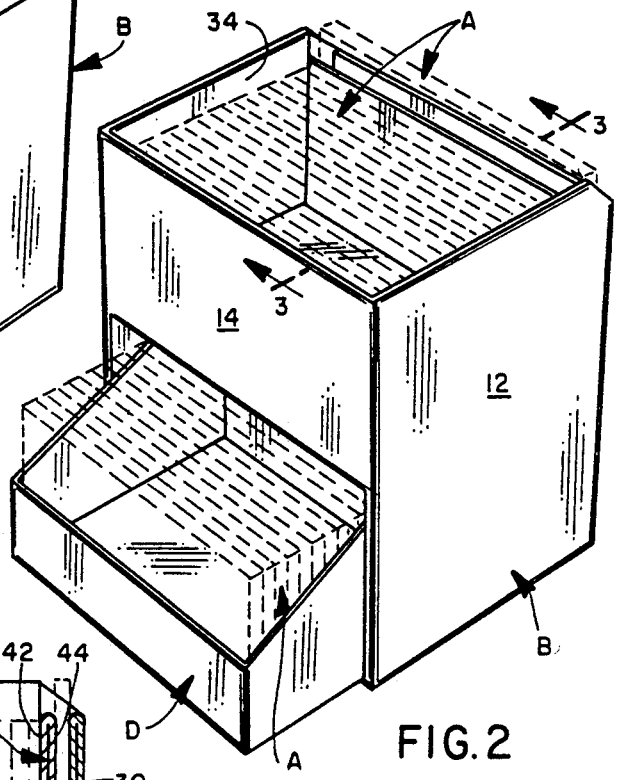
FIG. 2 is a view similar to that of FIG. 1, but with the display container shown with the lid removed and the drawer in an open position.

The upper insert member rear wall outer panel is spaced inwardly from the body member rear wall inner panel to form a space therebetween adapted to receive an article such as a book, as indicated at A FIG. 2.

After the upper insert member has been positioned in the body, the body side wall upper inner panels 34 and the body front wall inner panel 32 may be folded downwardly 180 to sandwich the related panels of the upper insert member between the inner and outer panels of the body member.

They may be locked in place by a Walker-lock arrangement, with the tabs 78 of the body panels being received within related openings 49 of the upper insert member bottom panel.

The drawer may then be inserted into the opening in the front of the body and pushed all the way back. Tabs 60*a* of the drawer outer bottom wall are engageable with related openings 29 in the body bottom wall inner panel 24 to provided an interlocking engagement therebetween and thereby prevent the drawer from being accidentally pulled out from the container body.

If it is desired to have a cover or lid for the container, the lid L may be formed and inserted on top of the container body after the upper compartment has been filled with articles.

The drawer may be pulled out part way to accommodate filling it with other articles.

If desired, a conventional tray T may be inserted into the drawer and maintained in position by interposing a tray front wall between the drawer front wall outer and inner panels and adhesively securing the inner panel to the tray front wall.

What is claimed is:

1. A display container for holding, displaying, and dispensing articles, said container including a plurality of components each being formed from a unitary sheet of foldable paperboard, and comprising:

(a) a generally rectilinear, vertically disposed, tubular body member open at the top, closed at the bottom, and having an uninterrupted horizontal bottom wall, three uninterrupted, vertical side walls, and one vertical side wall having a drawer receiving opening therein;

(b) said container having a shelf that extends between said body front, rear, and side walls and divides the interior of said body into separate upper and lower compartments above and below said shelf;

(c) a drawer member positioned for sliding movement into and out of said lower body compartment;

(d) said body and drawer members having interlocking means engageable with each other to prevent the accidental removal of said drawer member from said body member.

2. A display container according to claim 1, wherein said shelf is formed, at least partly, by one insert member positioned within said container body member.

3. A display container according to claim 2, wherein said one insert member is a lower insert member positioned in a lower portion of said container body member, and wherein said container includes an upper insert member positioned in an upper portion of said body member, and wherein said insert members have abutting panels that cooperate to form said shelf.

4. A display container according to claim 3, wherein said body member includes a plurality of inner panels foldably joined to upper edges of outer panels of certain of said vertical walls and folded 180 degrees inwardly, and wherein said upper insert member includes certain vertical panels, hinged to and upstanding from said upper insert member horizontal panel and interposed between certain of said body member vertical wall outer and inner panels.

5. A display container according to claim 3, wherein said upper insert member includes a vertical panel spaced inwardly from an adjacent body member vertical wall panel to provide an article receiving opening therebetween.

6. A display container according to claim 3, wherein said lower insert member includes a pair of vertical panels, extending downwardly from said lower insert member horizontal panel and interposed between inner and outer panels of certain of said body member vertical walls, and another vertical panel, extending upwardly from said lower insert member horizontal panel and interposed between inner and outer panels of another of said body member vertical walls.

7. A display container according to claim 1, wherein said interlocking means includes a body member bottom wall inner panel having at least one recess arranged and disposed for engagement with at least one lock tab foldably joined to a outer bottom panel of said drawer member.

8. A display container for holding, displaying, and dispensing articles, said container including a plurality of components each being formed from a unitary sheet of foldable paperboard, and comprising:

(a) a generally rectilinear, vertically disposed, tubular body member open at the top, closed at the bottom, and having an uninterrupted horizontal bottom wall, uninterrupted vertical rear and side walls, and a vertical front wall having a drawer receiving opening in a lower portion thereof;

(b) certain of said body member vertical walls each including inner and outer panels;

(c) a pair of upper and lower insert members positioned within said body member and having horizontal panels disposed in face-to-face relationship and cooperating with each other to form a shelf extending between said body member vertical walls to divide the interior of said body member into separate upper and lower compartments located above and below said shelf;

(d) said insert members having vertical panels sandwiched between certain of said body member vertical wall inner and outer panels to maintain said insert members in predetermined fixed positions within said body member;

(e) a drawer member positioned for sliding movement into and out of said body member lower compartment.

9. A display container according to claim 8, wherein said body and drawer members have interlocking means engageable with each other to prevent the accidental removal of said drawer member from said body member.

10. A display container according to claim 9, wherein said interlocking means includes a body member bottom wall inner panel having at least one recess arranged and disposed for engagement with at least one lock tab foldably joined to a outer bottom panel of said drawer member.

11. A display container according to claim 8, wherein said body member includes a plurality of inner panels foldably joined to upper edges of outer panels of certain of said vertical walls and folded 180 degrees inwardly, and wherein said upper insert member includes certain vertical panels, hinged to and upstanding from said upper insert member horizontal panel and interposed between certain of said body member vertical wall outer and inner panels.

12. A display container according to claim 8, wherein said upper insert member includes a vertical panel spaced inwardly from an adjacent body member vertical wall panel to provide an article receiving opening therebetween.

13. A display container according to claim 8, wherein said lower insert member includes a pair of vertical panels, extending downwardly from said lower insert member horizontal panel and interposed between inner and outer panels of certain of said body member vertical walls, and another vertical panel, extending upwardly from said lower insert member horizontal panel and interposed between inner and outer panels of another of said body member vertical walls.

14. A display container for holding, displaying, and dispensing articles, said container including a plurality of components each being formed from a unitary sheet of foldable paperboard, and comprising:

(a) a generally rectilinear, vertically disposed, tubular body member open at the top, closed at the bottom, and having an uninterrupted horizontal bottom wall, uninterrupted vertical rear and side walls, and a vertical front wall having a drawer receiving opening in a lower portion thereof;

(b) certain of said body member vertical walls each including inner and outer panels;

(c) at least one insert member positioned within said body member and having a horizontal panel forming a shelf extending between said body member vertical walls to divide the interior of said body member into separate upper and lower compartments located above and below said shelf;

(d) said insert member having at least one vertical panel sandwiched between certain of said body member vertical wall inner and outer panels to maintain said insert member in a predetermined fixed position within said body member;

(e) a drawer member positioned for sliding movement into and out of said body member lower compartment.

15. A display container according to claim 14, wherein said body and drawer members have interlocking means engageable with each other to prevent the accidental removal of said drawer member from said body member.

16. A display container according to claim 15, wherein said interlocking means includes a body member bottom wall inner panel having at least one recess arranged and disposed for engagement with at least one lock tab foldably joined to a outer bottom panel of said drawer member.

17. A display container according to claim 14, wherein said body member includes a plurality of inner panels foldably joined to upper edges of outer panels of certain of said vertical walls and folded 180 degrees inwardly, and wherein said insert member includes certain vertical panels, hinged to and upstanding from said insert member horizontal panel and interposed between certain of said body member vertical wall outer and inner panels.

18. A display container according to claim 14, wherein said upper insert member includes a vertical panel spaced inwardly from an adjacent body member vertical wall panel to provide an article receiving opening therebetween.

19. A display container according to claim 14, wherein said lower insert member includes a pair of vertical panels, extending downwardly from said lower insert member horizontal panel and interposed between inner and outer panels of certain of said body member vertical walls, and another vertical panel, extending upwardly from said lower insert member horizontal panel and interposed between inner and outer panels of another of said body member vertical walls.

* * * * *